US009390692B2

(12) United States Patent
Good

(10) Patent No.: US 9,390,692 B2
(45) **Date of Patent: *Jul. 12, 2016**

(54) PRECISION TRUE HOOP FOR DRUM

(71) Applicant: Drum Workshop, Inc., Oxnard, CA (US)

(72) Inventor: John J. Good, Thousand Oaks, CA (US)

(73) Assignee: DRUM WORKSHOP, INC., Oxnard, CA (US)

( * ) Notice: Subject to any disclaimer, the term of this patent is extended or adjusted under 35 U.S.C. 154(b) by 478 days.

This patent is subject to a terminal disclaimer.

(21) Appl. No.: 13/694,519

(22) Filed: Dec. 10, 2012

(65) Prior Publication Data

US 2015/0248877 A1 Sep. 3, 2015

Related U.S. Application Data

(63) Continuation-in-part of application No. 13/317,810, filed on Oct. 28, 2011, now Pat. No. 8,563,841.

(51) Int. Cl.
*G10D 13/02* (2006.01)
*B21D 53/16* (2006.01)

(52) U.S. Cl.
CPC ..... *G10D 13/023* (2013.01); *B21D 53/16* (2013.01)

(58) Field of Classification Search
CPC ..... G10D 13/023; G10D 13/085; G10C 3/12; G10C 3/02; G10C 1/00; G10C 3/00; G10H 2220/221; G10G 5/00; G10G 5/005; G10G 1/00; G10G 3/04; G10G 7/00
USPC ..... 84/411 R, 421
See application file for complete search history.

(56) References Cited

U.S. PATENT DOCUMENTS 887,016 A * 5/1908 Poland ..... G10D 13/023 84/411 R
4,416,181 A * 11/1983 Hartry ..... G10D 13/02 84/272
8,563,841 B1 * 10/2013 Good ..... 84/411 R
2013/0269819 A1 * 10/2013 Ruby et al. ..... 138/141

* cited by examiner

*Primary Examiner* — Kimberly Lockett
(74) *Attorney, Agent, or Firm* — Koppel, Patrick, Heybl & Philpott

(57) ABSTRACT

The method of drum structure formation that includes forming a strip of metal having an elongated edge into a counter hoop to be supported by a drum shell proximate the drum head, the forming including forming a reduced thickness strip bend proximate the hoop edge area.

25 Claims, 4 Drawing Sheets

PRECISION TRUE HOOP FOR DRUM

This application is a continuation-in-part of pending U.S. application Ser. No. 13/317,810, filed Oct. 28, 2011.

BACKGROUND OF THE INVENTION

This invention relates generally to the construction of drums, where drum sticks are used to strike hoops on the drums. More particularly, it concerns methods of construction of such hoops to avoid problems arising in their use.

In the past, the configurations of drum hoops led to problems of hoop distortion during their bend-formation, and of drainage from under the hoops, and also to problems of interference with drums sticks, as during impact (rim shots). Such impact with hoop edges can cause severe damage to drum sticks. Also, water and other particles tended to accumulate under hoops. There is need for structural changes overcoming these and other problems and disadvantages.

Problems relating to distortion of such hoops during their construction and assembly, led to inaccuracy and difficulty in drum tuning.

SUMMARY OF THE INVENTION

It is a major object of the invention to provide solutions to the above problems. Basically, the invention is embodied in drum structure formation, characterized by forming a strip of metal into a counter hoop to be supported by a drum shell proximate the drum head, and having a hoop shaped edge area formed to provide distortion free hoop structure and to resist or prevent drum stick damage, said forming including forming a reduced thickness bend proximate said edge area.

As will be seen, a gap is formed and located between the edge and the hoop side wall, the reduced thickness bend located at or near a hoop rolled outer surface spaced from the gap. The forming of reduced thickness is effected prior to forming of the strip of metal into hoop shape, and prior to forming of the bend, whereby resistance to hoop bending, and distortion, are reduced. Reduced thickness formation is effected by milling one side of the metal strip portion to be rolled.

Another object is to provide the rolled configuration extending toward the outer side of the hoop, for gap concealment.

Further objects include provision of a hoop flange to be spaced from and in offset relation to the reduced thickness area, and provision of sideward projections integral with the hoop, and spaced from the rolled edge, the projections defining openings for drum tensioning rods.

An advantage to a top rolled hoop of reduced thickness is that it enables distortion free hoop bending, and leaves a smooth rounded surface for the drummer to strike the drumstick, on and without causing damage to the stick. The standard drum counter hoop has a straight edge or just a slight radius that causes severe damage to the stick as it is struck. Another advantage is strength, provided by rolling the top edge of the hoop, which increases strength and distortion free stability of the hoop. A further advantage is provision of a hoop edge that is flat upon hoop bending. With the rolled edge adding strength, the hoop will tend to stay in such flat condition, even under high tension.

Yet another object is to provide a drum shell having a reduced thickness edge rolled toward the outer side of the hoop, reducing hoop distortion.

An important object is to provide a method of drum structure distortion free formation, that includes the following steps:

a) provide flat elongated strip of metal, b) locally mill a side portion of strip to provide reduced thickness along an edge portion of strip, c) deform the elongated strip to provide sideward tuning projections spaced from the reduced thickness ledge portion of strip, and also to form a seating edge for engagement with a drum head annular rim, d) roll the reduced thickness edge portion of the elongated strip to thereby form an elongated drum stick engaged rolled edge portion, or bend, such thickness reduction characterized as sufficient to prevent distortion of the hoop, out of annularity and to prevent distortion of said tuning projections during said rolling, and hoop bending.

e) bend the thus formed metal strip into hoop shape.

These and other objects and advantages of the invention, as well as the details of an illustrative embodiment, will be more fully understood from the following specification and drawings, in which:

DRAWING DESCRIPTION

Figure 1:
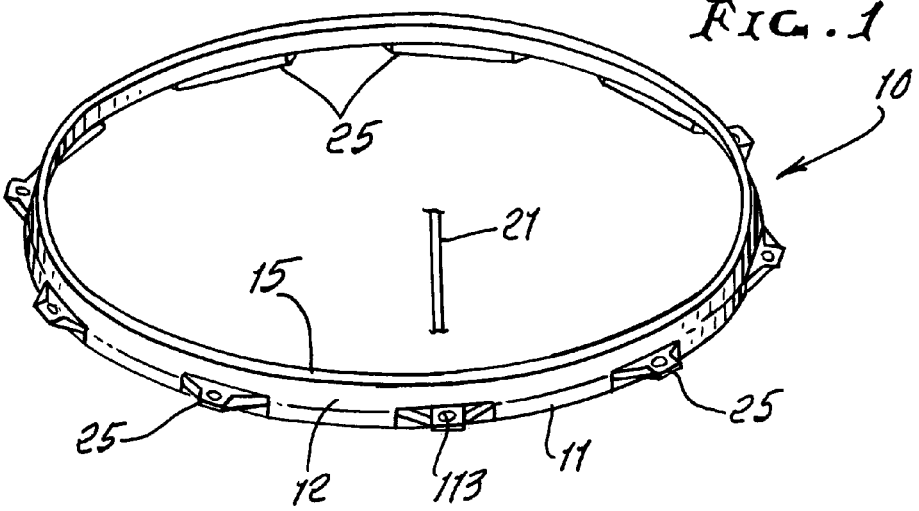
FIG. 1 is a perspective view of a drum hoop embodying the invention.
Figure 2:
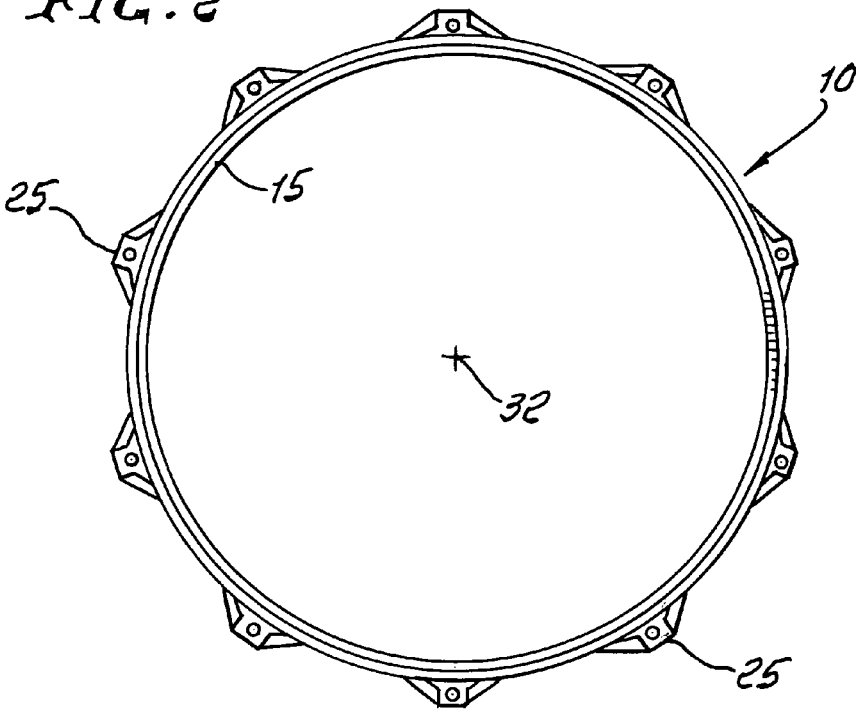
FIG. 2 is a plan view of the FIG. 1 hoop.
Figure 3:
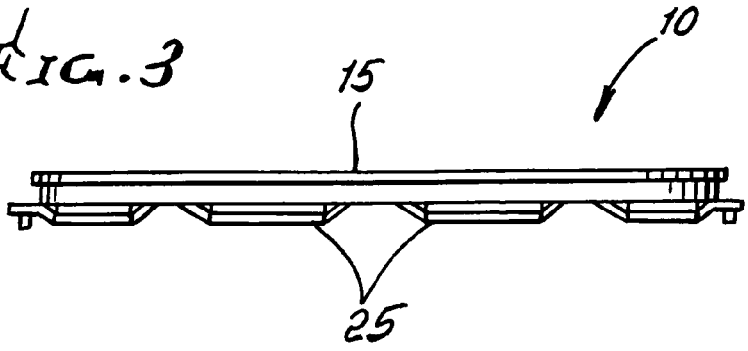
FIG. 3 is an edge view of the loop.
Figure 4:
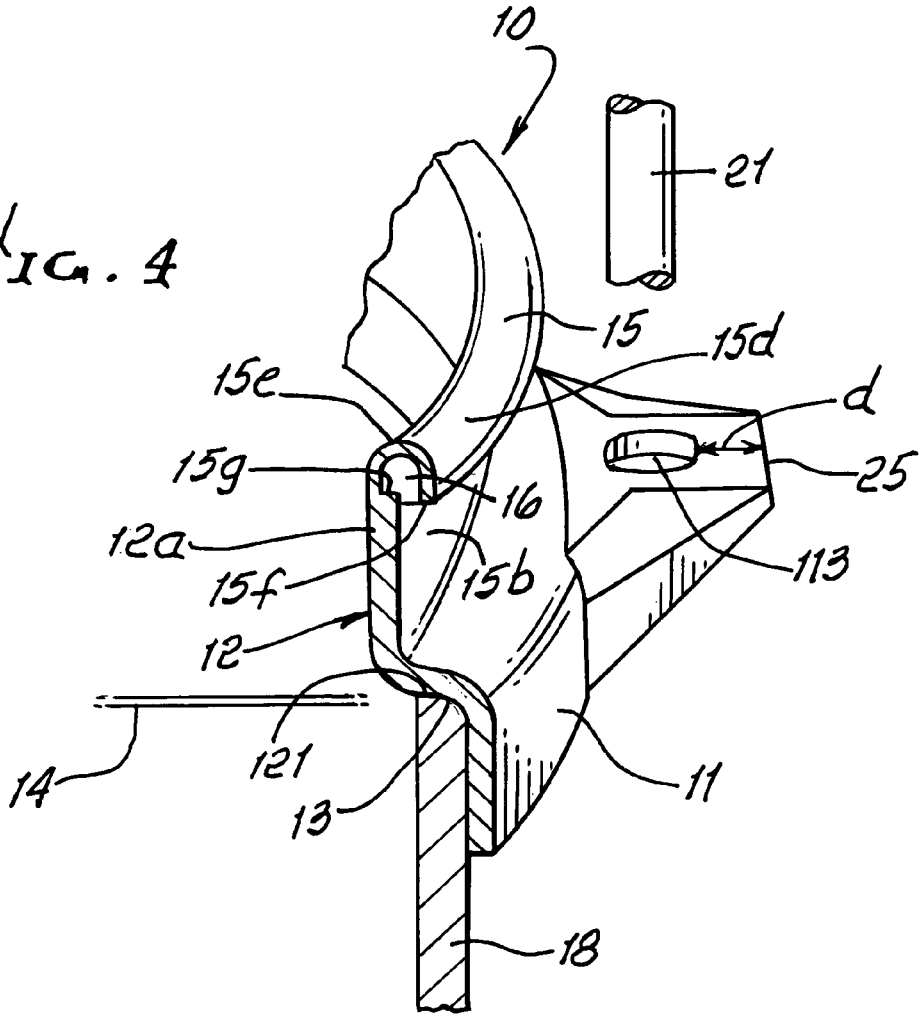
FIGS. 4 and 5 are enlarged fragmentary sections showing hoop construction.
Figure 4B:
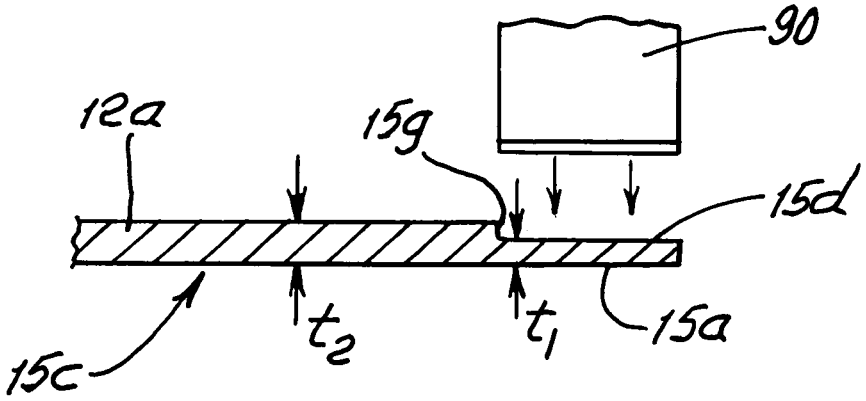
Figure 4C:
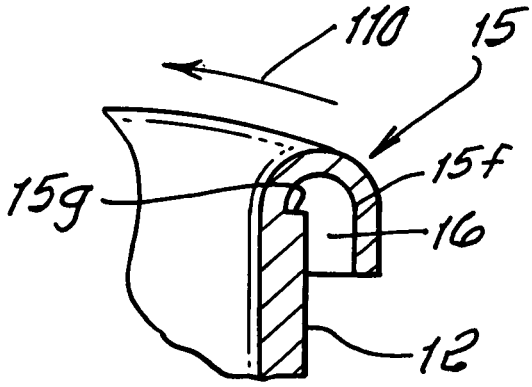
Figure 6:
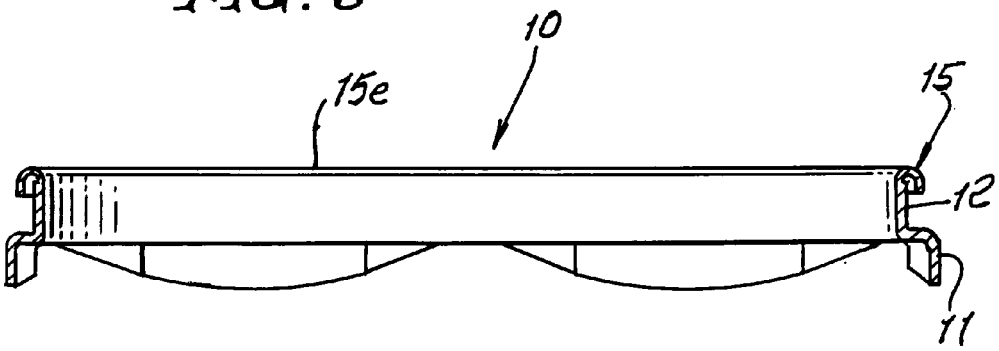

FIGS. 4*b*-4*c* are views showing processing of a hoop strip, prior to hoop formation; and FIG. 6 shows a complete hoop, in section.

DETAILED DESCRIPTION

The drum hoop 10 has metallic construction, with walls 11 and 12 offset to receive a drum wall 18 therebetween, i.e. beneath shoulder 13. Wall 12 has an upper edge 15 shaped to resist and prevent damage to a drum stick 17 which may at times impact that edge, during play. Edge 15 is shown, preferably, as rolled toward the outer side of the hoop, and to extend downwardly at 15*a*. The reduced thickness edge terminal 15*c*' faces inwardly toward wall 12, below ledge 15*g* with a small gap or opening 16 located between 15*c*' and wall 12, for water drainage. Outer side of wall 12 is shown at 15*b*. A typical thickness of wall 11 is about 2 millimeters.

Figure 5:
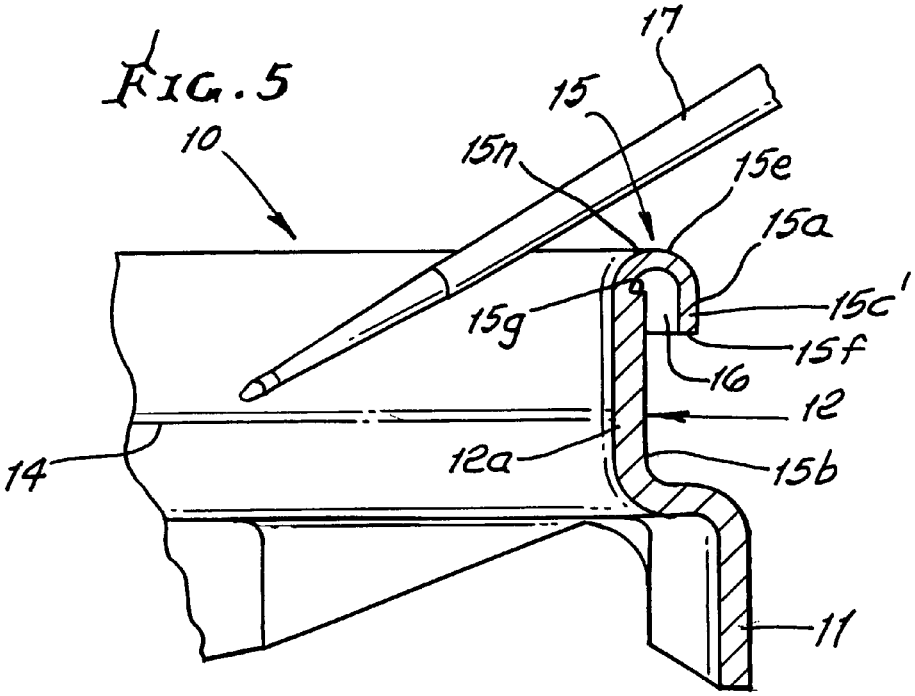

Preferably, the edge portion 15*a* that is rolled is of substantially reduced thickness at $t_1$ FIG. 4*b*, leaving the main extent 12*a* of wall 12 of relatively un-reduced thickness at $t_2$, below ledge 15*g*, in FIGS. 4 and 5. FIG. 4*b* shows the flat strip of material 15*c*, and milling tool 90 positioned to remove material at 15*d* leaving reduced thickness $t_1$. The length of 15*a* of reduced thickness between 15*f* and ledge 15*g* locates ledge 155. Above the level of terminal 15*f*. See also FIG. 4*c*, showing hoop formation bending in direction 110, about the hoop axis with substantially reduced resistance to bending being created due to reduced thickness at 15*a*, with less hoop distortion during hoop formation.

Location of gap 16, concealed and spaced below upper arcuate surface 15*e* and below ledge 15*g* prevents contact of the drum stick 17 with the terminal 15*f*, and any sharp edge thereof. Also, ledge 15*g* located as shown enables the approximately 180° rolled metallic extent at 15, 15*a* and 15*n* to have substantially reduced thickness relation to wall 11, to facilitate distortion free hoop formation.

A sideward projection 25 from the hoop provides an opening 113 for reception of a tensioning rod 21, in outwardly spaced relation from the gap 16. Space 112 between projection outer edge and through opening 113 that passes the tensioning rod, for tuning is kept constant.

A drum head is seen at 14, and a drum axis at 32. The method of drum distortion free formation includes the following steps:

a) provide flat elongated strip 15*c* of metal, b) locally mill a side portion of strip with tool 90 to provide reduced thickness at 15*d* along an edge portion of strip, c) deform the elongated strip to provide sideward tuning projections 25 spaced from the reduced thickness edge portion 15*a* of strip, and also to form a seating edge for engagement with a drum head annular rim 121, d) roll the reduced thickness edge portion of the elongated strip to thereby form an elongated drum stick engaged or engaging rolled and arcuate edge portion, or bend, as at 15*e*, that thickness reduction characterized as sufficient to prevent distortion of the hoop out of annularity and to prevent distortion of the tuning projections 25 during such rolling, and hoop bending, e) and bend the thus formed metal strip into hoop shape, with thickness reduction extending annularly.

Milling the metal strip 15*c* prior to forming the hoop bend ensures that there are no distortions on the underside, top and bottom of the flanged projections 25, whereby they remain perpendicular to wall 12, and distortion free. Accordingly, the distance "d" from the end of the flanged ear or projections to the edge of the oval hole 113 that passes the tensioning rod 212 is consistently the same, at all of the flanged ears 25 around the hoop. The configuration of the channel ledge 120 where the drum head 14 seats, is also consistently the same, around the hoop, whereby tuning of the drum is very simply optimized, and a true hoop configuration is achieved. FIG. 6 shows a completely formed hoop, in section.

I claim:

1. A method for forming a drum hoop, said method comprising:

forming a strip of metal comprising an elongated edge into a hoop;

forming a portion of said strip of metal into a thinned portion; and forming said elongated edge into a rolled bend.

2. The method of claim 1, wherein said forming of said thinned portion comprises milling said elongated edge to form said thinned portion.

3. The method of claim 1, wherein said rolled bend extends downwardly.

4. The method of claim 1, wherein said rolled bend is arcuate.

5. The method of claim 1, wherein said elongated edge comprises said thinned portion.

6. The method of claim 1, wherein forming said rolled bend comprises forming at least a portion of said thinned portion into at least a portion of said rolled bend.

7. The method of claim 1, wherein said rolled bend is rolled toward the outer side of the hoop.

8. The method of claim 6, wherein said thinned portion is milled.

9. The method of claim 1, wherein said forming of said thinned portion comprises milling.

10. A drum hoop comprising a wall shaped to define a hoop, wherein said wall is shaped to define a rolled edge portion; and wherein said rolled edge portion comprises a first portion thinner than the rest of said wall.

11. The drum hoop of claim 10, wherein said rolled edge portion is rolled toward the outside of said hoop.

12. The drum hoop of claim 10, wherein said rolled edge portion extends downwardly.

13. The drum hoop of claim 10, wherein said rolled edge portion extends vertically downward or past vertically downward.

14. The drum hoop of claim 10, wherein said rolled edge portion comprises an upper arcuate surface.

15. The drum hoop of claim 10, wherein said drum hoop is shaped to fit on a drum head.

16. The drum hoop of claim 15, wherein said drum hoop is configured to engage said drum head.

17. The drum hoop of claim 10, further comprising one or more sideward projections spaced from said rolled edge portion and shaped to define an opening for a drum tensioning rod.

18. The drum hoop of claim 10, wherein said drum hoop is shaped to define a seating edge for engagement with a drum head or drum shell.

19. A method for forming a drum hoop, said method comprising:

milling an elongated edge of a strip of metal;

forming said strip of metal into a hoop; and forming said elongated edge into a rolled bend.

20. The method of claim 19, wherein said rolled bend is rolled toward the outer side of said hoop.

21. The method of claim 19, wherein said rolled bend extends downwardly.

22. The method of claim 19, wherein said rolled bend extends vertically downward or past vertically downward.

23. The method of claim 19, wherein said milled elongated edge is thinner than the rest of said strip of metal.

24. The method of claim 19, wherein said rolled bend is arcuate.

25. The method of claim 1, further comprising forming one or more sideward projections spaced from said rolled edge portion and shaped to define an opening for a drum tensioning rod.

* * * * *